US009289062B1

(12) United States Patent
Posa

(10) Patent No.: US 9,289,062 B1
(45) Date of Patent: Mar. 22, 2016

(54) WINE BOTTLE STORAGE RACKS

(71) Applicant: John G. Posa, Ann Arbor, MI (US)

(72) Inventor: John G. Posa, Ann Arbor, MI (US)

( * ) Notice: Subject to any disclaimer, the term of this patent is extended or adjusted under 35 U.S.C. 154(b) by 0 days.

(21) Appl. No.: 14/560,997

(22) Filed: Dec. 4, 2014

(51) Int. Cl.
*A47B 73/00* (2006.01)
*A47B 47/04* (2006.01)
*A47B 47/00* (2006.01)

(52) U.S. Cl.
CPC ..... *A47B 73/00* (2013.01); *A47B 47/0066* (2013.01); *A47B 47/042* (2013.01)

(58) Field of Classification Search
CPC ... A47B 73/00; A47B 47/0066; A47B 47/042
USPC ..... 211/74
See application file for complete search history.

(56) References Cited

U.S. PATENT DOCUMENTS

| | | | | | |
|---|---|---|---|---|---|
| 85,208 | A * | 12/1868 | Burrow | A47B 73/00 211/74 |
| 3,241,661 | A * | 3/1966 | Zamzow et al. | 206/433 |
| 3,416,648 | A * | 12/1968 | Levi | 206/141 |
| 3,606,023 | A * | 9/1971 | Edmunds | A47B 73/006 211/194 |
| 4,341,308 | A * | 7/1982 | Pasquini | 206/427 |
| 4,494,788 | A * | 1/1985 | Altemose | A45F 5/10 294/159 |
| 5,624,043 | A * | 4/1997 | Baptista | 211/74 |
| 5,826,731 | A * | 10/1998 | Dardashti | 211/74 |
| 5,950,831 | A * | 9/1999 | Millet | 206/446 |
| 5,975,314 | A * | 11/1999 | Lee | 211/13.1 |
| 8,132,871 | B1 * | 3/2012 | Caruso | 312/310 |
| 2005/0011843 | A1 * | 1/2005 | Dagan | 211/74 |
| 2011/0049068 | A1 * | 3/2011 | Potter | 211/69.1 |
| 2011/0278247 | A1 * | 11/2011 | Moffly | 211/74 |

* cited by examiner

*Primary Examiner* — Michael Safavi
(74) *Attorney, Agent, or Firm* — Dinsmore & Shohl LLP

(57) ABSTRACT

Racks are disclosed for storing a plurality of wine bottles, each bottle having a bottom portion and a neck portion. Each rack comprises a housing having two opposing side panels connected to a back panel, at least one of the side panels having a plurality of holes or notches. One or more structures are provided in the housing to receive the bottom portions of the wine bottles, such that the bottles are stored at angles with the neck of each wine bottle extending outwardly through a respective one of the holes or notches. The side panels may curve into an upper point to form a boat-shaped housing. The rack may include a plurality of V-shaped structures or a zig-zag structure mounted on the back panel to receive the bottom portions of the wine bottles. Mirror-image and staggered bottle storage embodiments are described.

14 Claims, 9 Drawing Sheets

WINE BOTTLE STORAGE RACKS

FIELD OF THE INVENTION

This invention relates generally to wine bottle storage racks and, in particular, to boat-shaped wine bottle storage racks having side panels through which the necks of the bottles extend.

BACKGROUND OF THE INVENTION

There are numerous wine bottle storage rack designs, including some that are boat-shaped. However, none have side panels through which the necks of the bottles extend.

SUMMARY OF THE INVENTION

This invention resides in a rack for storing a plurality of wine bottles, each bottle having a bottom portion and a neck portion. The rack comprises a housing having two opposing side panels connected to a back panel, one or both of the side panels having a plurality of holes. One or more structures are provided to receive the bottom portions of the wine bottles, such that the bottles are stored at angles between horizontal and vertical with the neck of each wine bottle extending outwardly through a respective one of the holes in the side panel(s).

The rack has an upper end and, in the preferred embodiment the side panels curve and converge at a point at the upper end so that the housing is boat-shaped. The rack may include a plurality of V-shaped structures or a zigzag structure mounted on the back panel to receive the bottom portions of the wine bottles. The holes in the side panels may be circular with a diameter in the range of 1.5 to 3 inches. The geometries of the holes and the structures mounted on the back panel may cause the bottles to be stored at an angle of 20 to 45 degrees from horizontal, with right and left vertical stacks of bottles that are staggered or mirror images of one another.

DETAILED DESCRIPTION OF THE INVENTION

Figure 43:
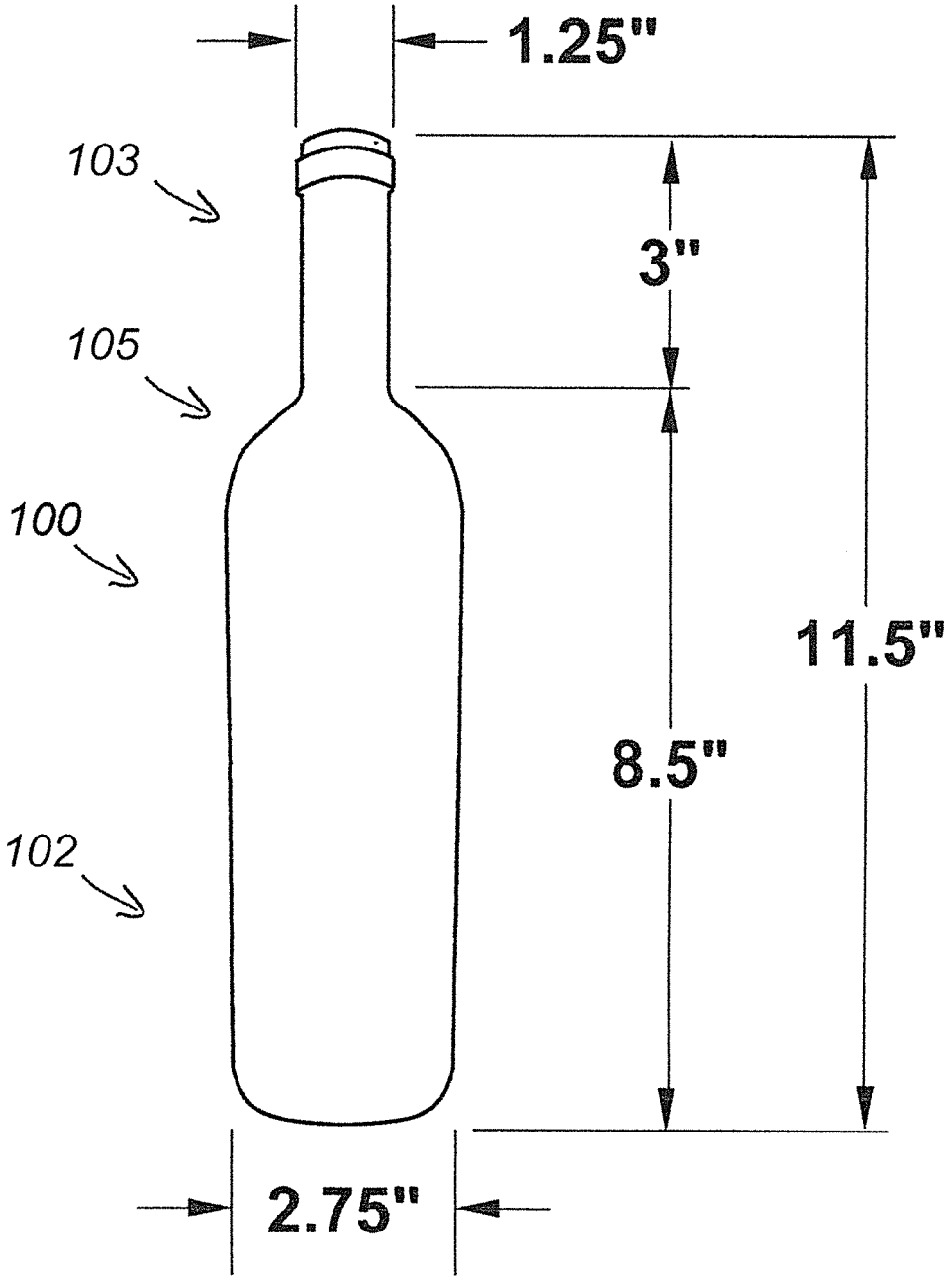
FIG. 43 is a drawing of a typical bottle for red wine with average dimensions.

Prior to discussing the invention, FIG. 43 illustrates a typical wine bottle showing the dimensions thereof. The bottle 100 has a lower, cylindrical body portion 102 with a diameter on the order of 2.75 inches, an upper neck portion with a diameter of about 1.25 inches, and a shoulder portion between the body portion and the neck portion. The height of a typical bottle is approximately 11.5 inches, with the height to the shoulder portion being about 8.5 inches and the height of the neck being about 3 inches. While the various embodiments of the invention are intended to accommodate bottles of the type shown in FIG. 43, the invention is not limited in this regard in that bottles for white wine, champagne, etc., having somewhat different dimensions may also be accommodated.

Figure 6:
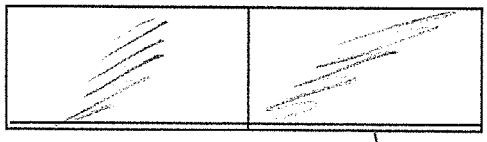
FIG. 6 is a top view of the wine bottle storage rack of claim 1.
Figure 3:
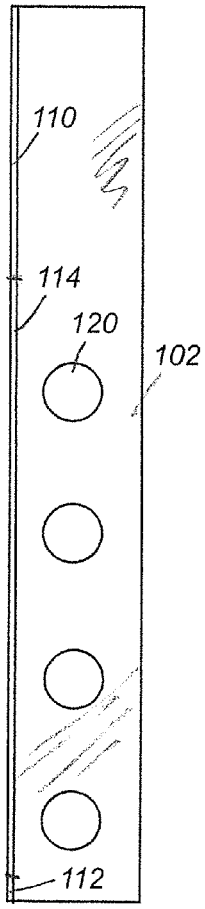
FIG. 3 is a side view of the wine bottle storage rack of claim 1.
Figure 1:
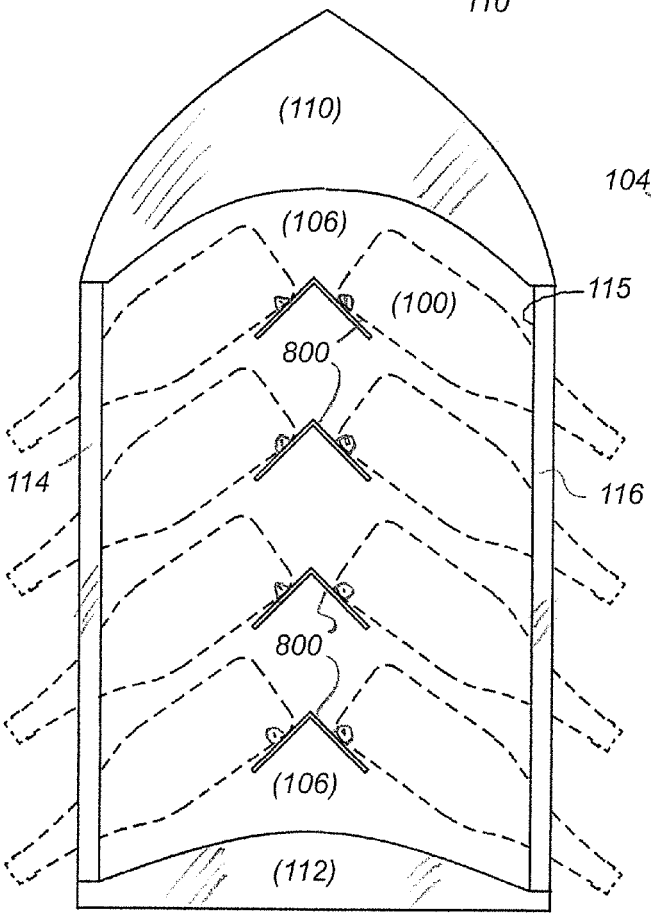
FIG. 1 is a front view of a wine bottle storage rack constructed in accordance with the invention wherein bottles are stored in two opposing mirror-image stacks.
Figure 4:
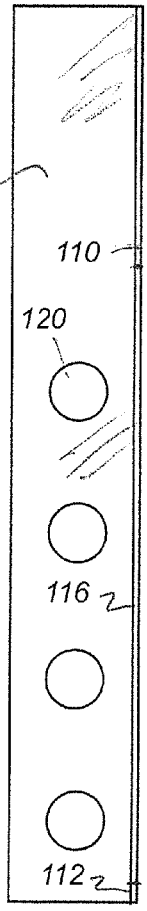
FIG. 4 is a different side view of the wine bottle storage rack of claim 1.
Figure 7:
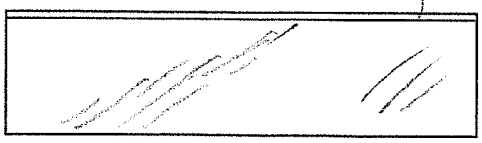
FIG. 7 is a bottom view of the wine bottle storage rack of claim 1.
Figure 2:
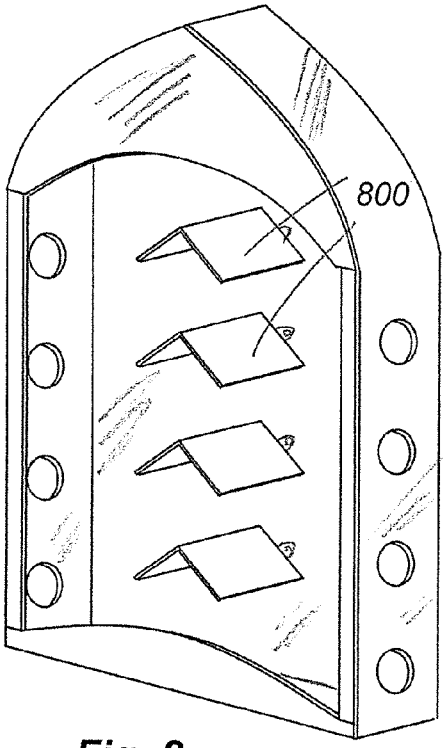
FIG. 2 is an oblique view of the wine bottle storage rack of claim 1.
Figure 5:
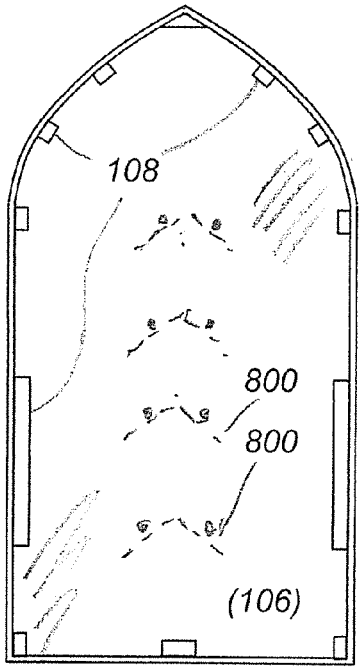
FIG. 5 is a back view of the wine bottle storage rack of claim 1.
Figure 18:
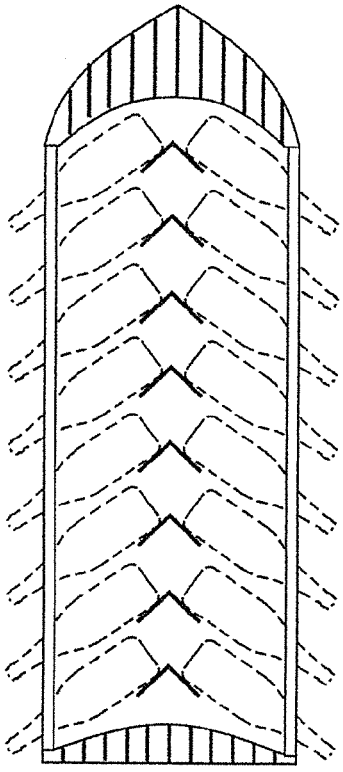
FIG. 18 shows how any of the embodiments disclosed herein may be extended lengthwise and/or use beaded decorative front panels.

FIG. 1 is a front view of a preferred embodiment of the invention. FIG. 2 is an oblique view; FIG. 3 is a view of one side; FIG. 4 is a view of the other side; FIG. 5 is a back view; FIG. 6 is a top view; and FIG. 7 is a bottom view. This embodiment includes a pair of opposing side panels mounted to a back panel 106 using glue blocks 108 shown in FIG. 5. Decorative top panels 110, 112 may be added, and may include pin striping using "bead board," for example, to provide a 'teak and holly' appearance as shown in FIG. 18. Side strips 114, 116 may be added to cover the exposed edges of side panels 102, 104.

Each side panel 102, 104 includes a plurality of through-holes 120, each configured to receive the neck portion of a respective one of the bottles 100. The various panels are preferably made of wood. The side panels are preferably constructed from bendable plywood, with veneer facings being used to approximate the look of old mahogany wooden Kris Kraft® type boats. In the configuration of FIG. 1, with the ability to store 8 bottles as shown, the overall dimensions of the housing would be about 24 to 32 inches tall, 3 to 8 inches deep, and 18 to 24 inches wide. The spacing of the side holes is on the order of 3.5 to 6 inches from center-to-center. More preferred dimensions are 30 inches tall, 5 to 6 inches deep, 20 inches wide, with the spacing of the side holes in the range of 4 to 5 inches from center-to-center.

One or more structures are added to the back panel to keep the bottles 100 at angles between horizontal and vertical with the neck of each wine bottle extending outwardly through a respective one of the holes in the side panels. For example, the geometries of the holes and the structures mounted on the back panel may cause each bottle to be stored at an angle of 30 to 45 degrees from horizontal.

Figure 8:
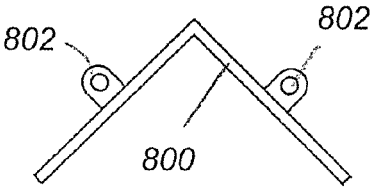
FIG. 8 is a detail drawing of a V-shaped support bracket.

In the preferred embodiment, a plurality of V-shaped structures 800 are used to support the bottom portions of the bottles. The structures shown in FIG. 8 are made from metal such as brass, aluminum, or stainless steel, with tabs 802 enabling the supports to be mounted on the back panel with nuts-bolts or other appropriate fasteners. The advantage of the V-shaped supports is that the same component may be used for the "mirror-image" bottle configuration of FIGS. 1-7 and the "staggered" bottle configuration of FIGS. 10-17 by simply rotating the supports.

Figure 9:
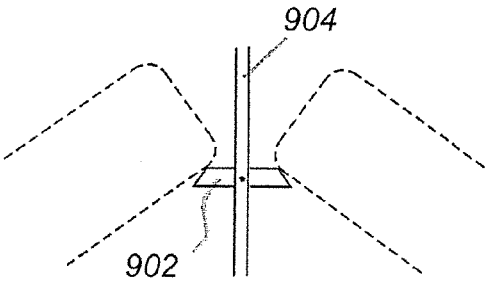
FIG. 9 is a detail drawing of a wooden support structure.
Figure 15:
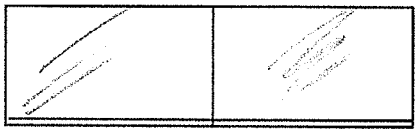
FIG. 15 is a top view of the wine bottle storage rack of claim 10.
Figure 12:
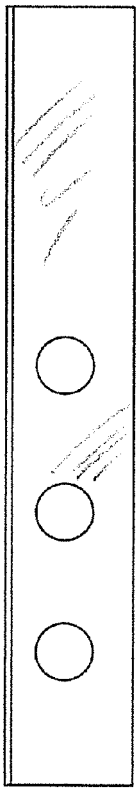
FIG. 12 is a side view of the wine bottle storage rack of claim 10.
Figure 10:
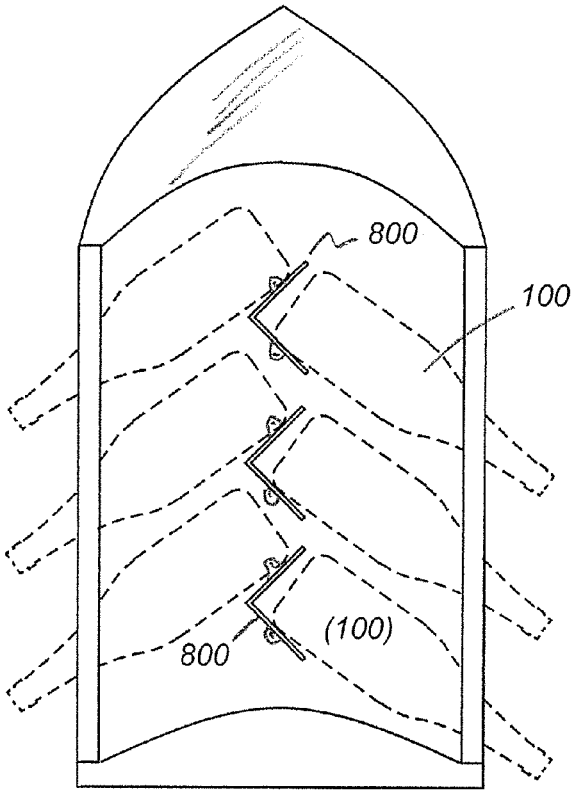
FIG. 10 is a front view of a wine bottle storage rack constructed in accordance with the invention wherein bottles are stored in two staggered stacks.
Figure 13:
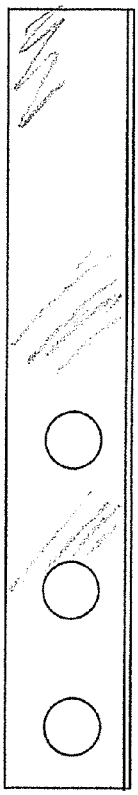
FIG. 13 is a different side view of the wine bottle storage rack of claim 10.
Figure 16:
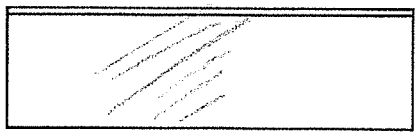
FIG. 16 is a bottom view of the wine bottle storage rack of claim 10.
Figure 14:
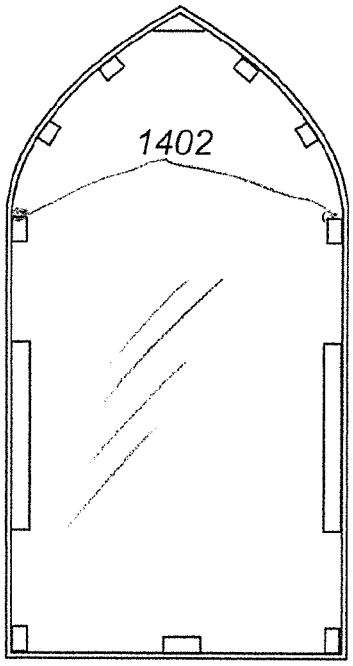
FIG. 14 is a back view of the wine bottle storage rack of claim 10.
Figure 11:
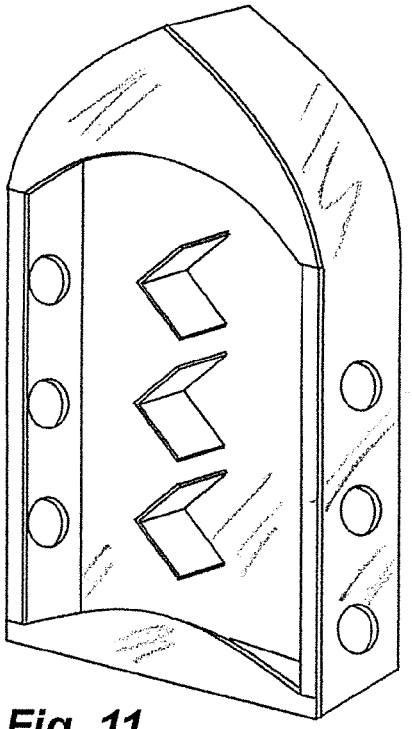
FIG. 11 is an oblique view of the wine bottle storage rack of claim 10.
Figure 17:
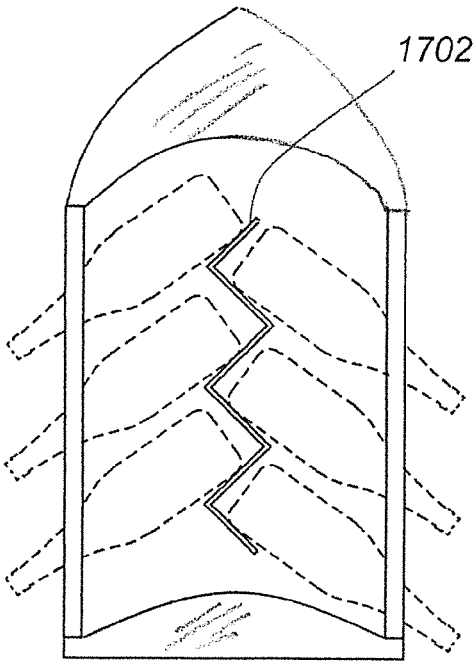
FIG. 17 illustrates a zigzag support structure.

Although the V-shaped support structures are preferably bent metal, wood supports 902 may be used as shown in FIG. 9. A strip 904 may be used for further stabilization. The zigzag support structure 1702 of FIG. 17 may also be made of wood pieces as opposed to bent metal (or plastic). The racks described herein may be hung from a wall using an appropriate hanger 1402 as shown in FIG. 14 or the unit may be placed on a shelf. If the rack is made tall, as shown in FIG. 18, the rack may be placed on the floor.

Figure 24:
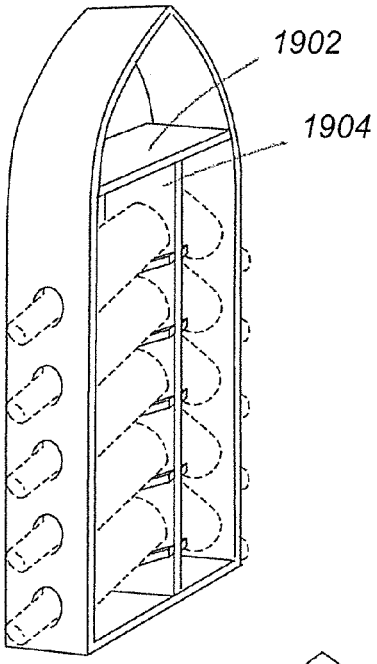
FIG. 24 is an oblique view of the embodiment of FIG. 19.
Figure 19:
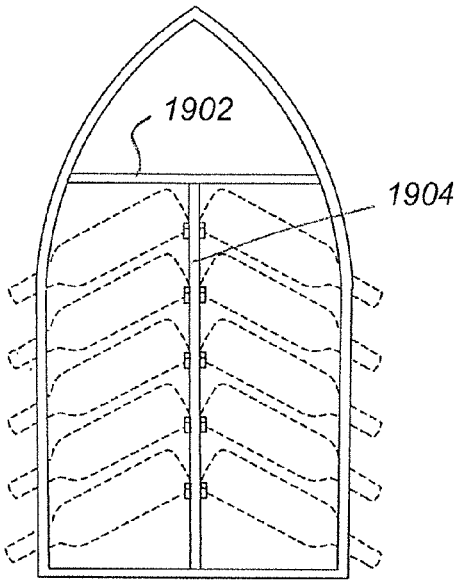
FIG. 19 is a front view of an embodiment of the invention having an upper shelf.
Figure 20:
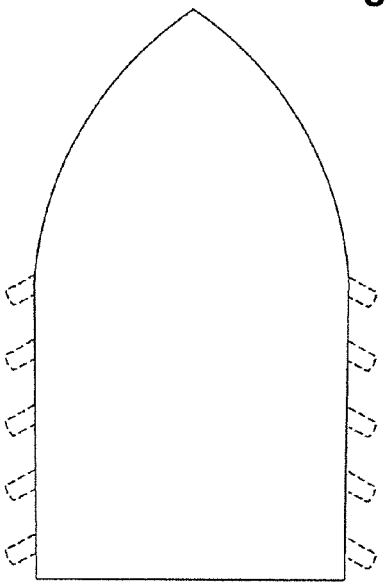
FIG. 20 is a back view of the embodiment of FIG. 19.
Figure 21:
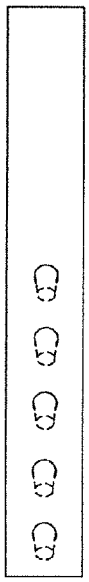
FIG. 21 is a side view of the embodiment of FIG. 19.
Figure 22:
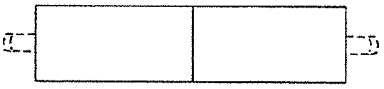
FIG. 22 is a top view of the embodiment of FIG. 19.
Figure 23:
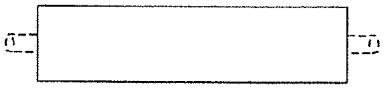
FIG. 23 is a bottom view of the embodiment of FIG. 19.

FIG. 19 is a front view of an embodiment of the invention having an upper shelf 1902 that may conveniently hold glasses, corkscrews, etc. FIG. 20 is a back view, FIG. 21 is a side view, FIG. 22 is a top view, FIG. 23 is a bottom view, and FIG. 24 is an oblique view of the embodiment of FIG. 19. These Figures show a vertical rib 1904 separating the housing into right and left halves, each accommodating two side-by-side stacks of 5 bottles each for a total of 10 bottles. However, as with the other embodiments disclosed herein, the box may be made shorter or taller to accommodate fewer or more bottles. In all embodiments, the bottles are preferably stored in a tilted orientation to keep the corks moist, and if holes are used, they may be round or oval, and may be tapered for better conformance with the shoulder portions of the bottles.

Figure 26:
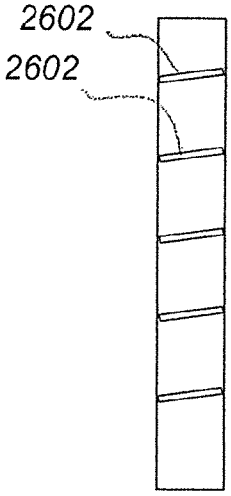
FIG. 26 is a detail view showing straight bottle supports which may be slanted, as shown.
Figure 27:
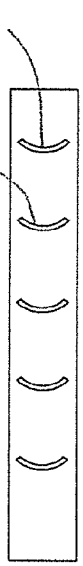
FIG. 27 is a detail view showing curved bottle supports.
Figure 25:
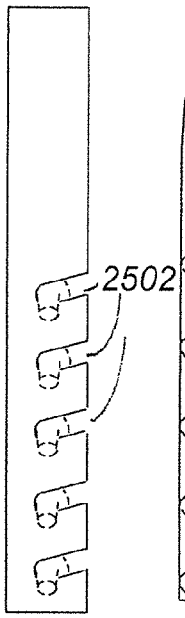
FIG. 25 is a side view showing the use of notches as opposed to holes through the sidewalls.
Figure 29:
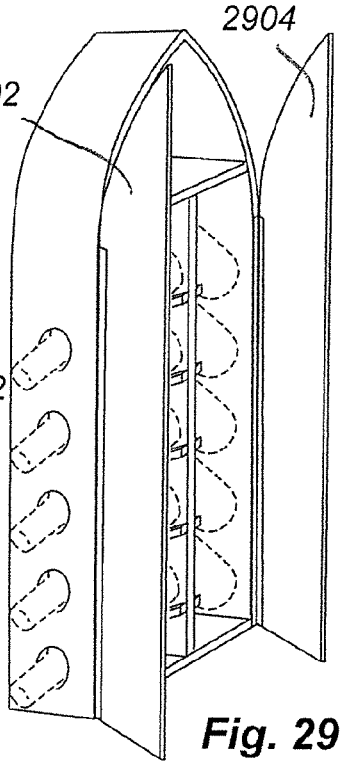
FIG. 29 is a drawing showing how doors or locking doors may be provided.
Figure 30:
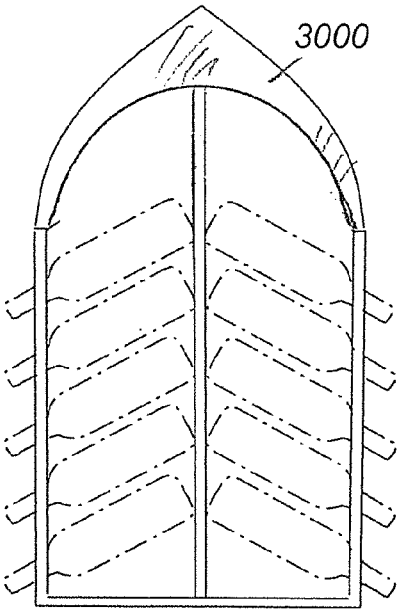
FIG. 30 is a drawing of a further, optional bow deck detail.
Figure 28:
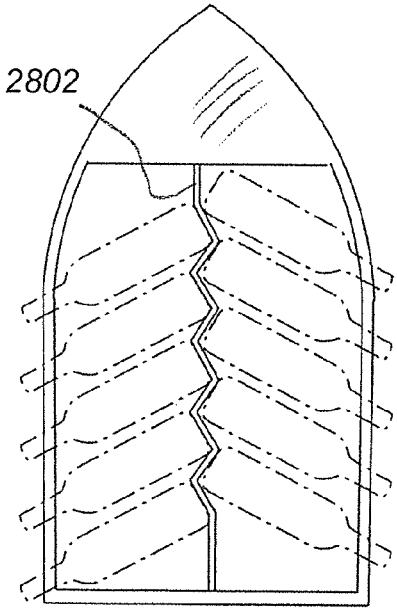
FIG. 28 is a drawing of an optional, full-length vertical rib.

FIG. 25 is a side view showing the use of notches 2502 as opposed to holes through the sidewalls. FIG. 26 is a detail view showing how straight bottle supports 2602 may be slanted to keep bottles from rolling out. FIG. 27 is a detail view showing curved bottle supports 2702. FIG. 28 is a drawing of an optional, full-length vertical rib 2802. FIG. 29 is a drawing showing how doors 2902, 2904, including locking doors, may be provided. FIG. 30 is a drawing of a further, optional bow deck detail 3000.

Figure 36:
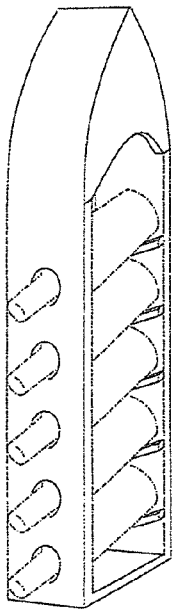
FIG. 36 is an oblique view of the embodiment of FIG. 31.
Figure 31:
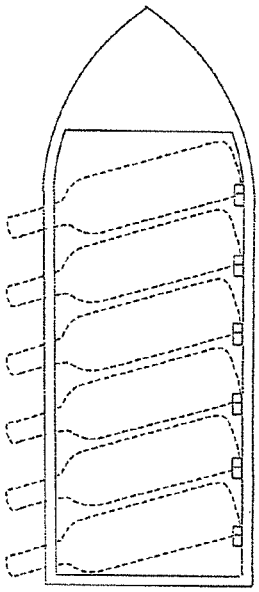
FIG. 31 is a front view of an alternative embodiment of the invention having a single stack of bottles as opposed to two side-by-side stacks.
Figure 33:
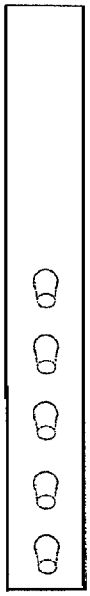
FIG. 33 is a side view of the embodiment of FIG. 31.
Figure 32:
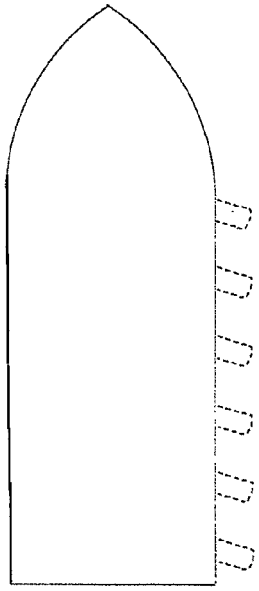
FIG. 32 is a back view of the embodiment of FIG. 31.
Figure 34:
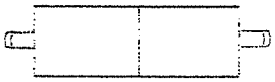
FIG. 34 is a top view of the embodiment of FIG. 31.
Figure 35:
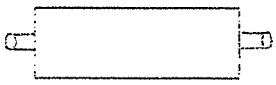
FIG. 35 is a bottom view of the embodiment of FIG. 31.
Figure 42:
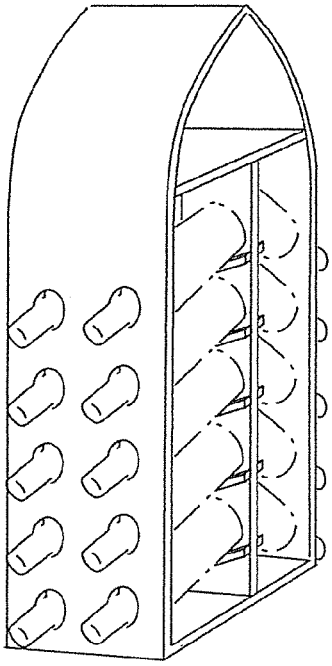
FIG. 42 is an oblique view of the embodiment of FIG. 37.
Figure 37:
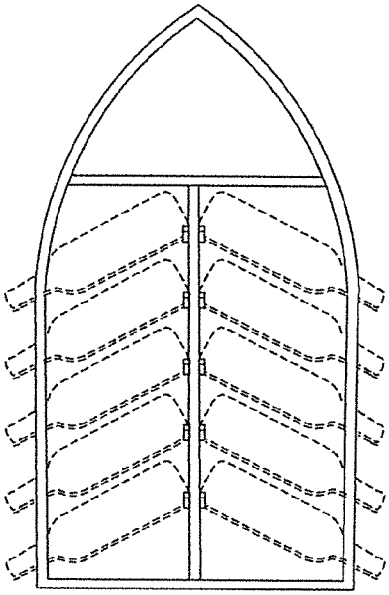
FIG. 37 is a front view of a further alternative embodiment of the invention having two layers of bottles arranged from back to front.
Figure 38:
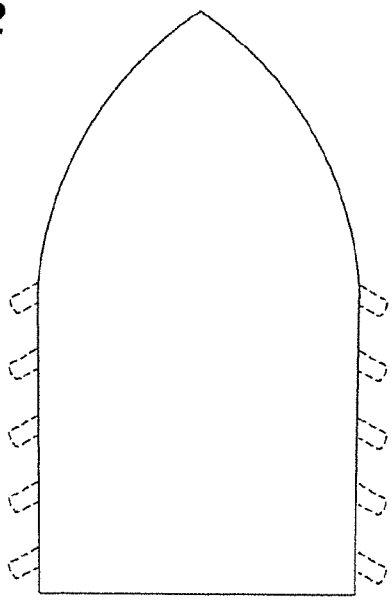
FIG. 38 is a back view of the embodiment of FIG. 37.
Figure 39:
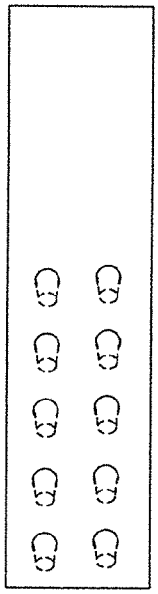
FIG. 39 is a side view of the embodiment of FIG. 37.
Figure 40:
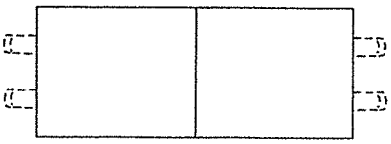
FIG. 40 is a top view of the embodiment of FIG. 37.
Figure 41:
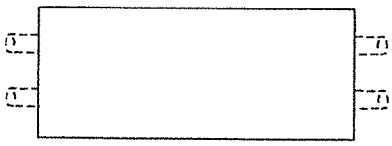
FIG. 41 is a bottom view of the embodiment of FIG. 37.

FIG. 31 is a front view of an alternative embodiment of the invention having a single stack of bottles as opposed to two side-by-side stacks. FIG. 32 is a back view, FIG. 33 is a side view, FIG. 34 is a top view, FIG. 35 is a bottom view, and FIG. 36 is an oblique view of the embodiment of FIG. 31. FIG. 37 is a front view of a further alternative embodiment of the invention having two layers of bottles arranged from back to front. FIG. 38 is a back view, FIG. 39 is a side view, FIG. 40 is a top view, FIG. 41 is a bottom view, and FIG. 42 is an oblique view of the embodiment of FIG. 37.

The invention claimed is:

1. A rack for storing a plurality of wine bottles, each bottle having a bottom portion transitioning to a neck portion through a shoulder portion, the rack comprising:

a housing having an open front bordered by two opposing side panels with inner surfaces, and wherein the side panels are connected to a back panel;

one or both of the side panels having a plurality of vertically spaced-apart holes that are larger than the neck portions of the bottles but smaller than the bottom portions of the bottles; and one or more structures mounted on the back panel adapted to support the bottom portions of wine bottles, such that the bottles are stored at non-horizontal angles in the housing with the shoulder of each bottle resting against the inner surface of one of the side panels, with the neck of each wine bottle extending downwardly and outwardly through a respective one of the holes in the side panels.

2. The rack of claim 1, having an upper end, and wherein the side panels curve and converge at a point at the upper end such that the housing is boat-shaped.

3. The rack of claim 1, wherein the one or more structures mounted on the back panel comprise a plurality of inverted V-shaped structures adapted to support the bottom portions of the wine bottles.

4. The rack of claim 1, wherein the one or more structures mounted on the back panel comprise a zigzag structure adapted to support the bottom portions of the wine bottles.

5. The rack of claim 1, wherein the holes in the side panels are circular with a diameter in the range of 1.5 to 3 inches.

6. The rack of claim 1, wherein the geometries of the holes and the one or more structures mounted on the back panel are adapted to support each bottle at an angle of 20 to 45 degrees from horizontal.

7. The rack of claim 1, wherein:

both of the side panels have a plurality of vertically spaced-apart holes; and the one or more structures mounted on the back panel are adapted to support right and left vertical stacks of bottles that are mirror images of one another, with the necks of some of the bottles protruding through the holes in one of the side panels, and with the necks of the other bottles protruding through the holes in the other side panel.

8. The rack of claim 1, wherein:

both of the side panels have a plurality of vertically spaced-apart holes; and the one or more structures mounted on the back panel are adapted to support right and left vertical stacks of bottles that are staggered relative to one another, with the necks of some of the bottles protruding through the holes in one of the side panels, and with the necks of the other bottles protruding through the holes in the other side panel.

9. A rack adapted to receive a plurality of wine bottles, each wine bottle having a lower, cylindrical body portion with a diameter, an upper neck portion with a diameter smaller than that of the body portion, and a shoulder portion between the body portion and the neck portion, each bottle further having a bottom portion and a height from the bottom portion to the shoulder portion, the rack comprising:

a housing having an open front and opposing side panels with inner surfaces;

wherein both side panels terminate in a common top edge defining a boat-shaped housing;

a plurality of notches in, or holes through, at least one of the side panels, each notch or hole having inner dimensions larger than the neck portions of the bottles but smaller than the cylindrical body portions of the bottles; and whereby, when the bottles are correctly positioned in the rack, the shoulder of each bottle rests against the inner surface of one of the side panels having holes or notches, with each bottle being tilted at a non-horizontal angle, with only the neck of each bottle protruding through a respective one of the notches or holes in the side panel.

10. The rack of claim 9, wherein the side panels are solid panels except for the holes or notches.

11. The rack of claim 9, further including a back panel having opposing side edges to which the opposing side panels are joined.

12. The rack of claim 9, further including a back panel having opposing side edges to which the opposing side panels are joined, the side edges terminating in a pointed top defining a boat-shaped back panel.

13. The rack of claim 9, further including a central vertical rib and notches or holes through both opposing side panels.

14. The rack of claim 9, including a plurality of bottom rest surfaces adapted to support each bottle at an angle between 20 to 45 degrees from horizontal.

* * * * *